US006830441B1

(12) United States Patent
Williams

(10) Patent No.: US 6,830,441 B1
(45) Date of Patent: Dec. 14, 2004

(54) VALVE FOR DOWNHOLE PUMP

(75) Inventor: Benny J. Williams, Godley, TX (US)

(73) Assignee: Harbison-Fischer Manufacturing Company, Crowley, TX (US)

( * ) Notice: Subject to any disclaimer, the term of this patent is extended or adjusted under 35 U.S.C. 154(b) by 0 days.

(21) Appl. No.: 10/289,904

(22) Filed: Nov. 7, 2002

Related U.S. Application Data

(60) Provisional application No. 60/334,885, filed on Nov. 15, 2001.

(51) Int. Cl.[7] ..... F04B 39/00; F04B 39/10; E21B 43/00; E21B 27/00

(52) U.S. Cl. ..... 417/555.1; 417/430; 417/547; 417/554; 417/555.2; 166/105; 166/107; 166/109

(58) Field of Search ..... 417/53, 430, 460, 417/547, 552, 554, 555.1, 556.2; 137/512, 529, 533.11, 533.12, 533.19, 539.5, 517, 525; 251/338, 361, 364, 368; 166/105, 107, 109, 313, 320, 50

(56) References Cited

U.S. PATENT DOCUMENTS

| | | | | |
|---|---|---|---|---|
| 1,443,016 A | | 1/1923 | Eubanks | |
| 1,626,549 A | | 4/1927 | Miller | |
| 1,706,593 A | * | 3/1929 | Sargent | 137/515.5 |
| 2,192,541 A | | 3/1940 | Davis | |
| 2,231,861 A | * | 2/1941 | Adams | 417/459 |
| 2,937,659 A | | 5/1960 | Harris et al. | |
| 3,134,572 A | * | 5/1964 | Glasgow | 251/363 |
| 3,724,496 A | * | 4/1973 | Secrist | 137/533.13 |
| 4,495,006 A | * | 1/1985 | Aves, Jr. et al. | 148/217 |
| 4,990,233 A | * | 2/1991 | Hahn | 427/529 |
| 5,178,184 A | | 1/1993 | Skillman | |
| 5,472,326 A | | 12/1995 | Tarpley | |
| 5,593,289 A | * | 1/1997 | Tarpley | 417/454 |
| 5,593,292 A | * | 1/1997 | Ivey | 417/554 |
| 6,258,172 B1 | | 7/2001 | Foster et al. | |
| 6,273,690 B1 | | 8/2001 | Fischer, Jr. et al. | |

OTHER PUBLICATIONS

Joseph P. Mesina, Pump Handbook, 1985, McGraw–Hill Book Co., 2nd Edition, p. 9.280.*

Harbison–Fischer Mfg. Co. website pages, One Piece Cages, 2 pages.

Harbison–Fischer Mfg. Co. website pages, Harbison–Fischer John Martin Rubber Lined Cages, 2 pages.

Harbison–Fischer Mfg. Co. website pages, Insert Guides Cages, 2 pages.

Harbison–Fischer Mfg. Co. website pages, Sucker Rod Pump Balls and Seats, 2 pages.

* cited by examiner

*Primary Examiner*—Justine R. Yu
*Assistant Examiner*—Timothy P. Solak
(74) *Attorney, Agent, or Firm*—Geoffrey A. Mantooth

(57) ABSTRACT

A downhole pump having a barrel with a reciprocating plunger therein has at least one valve. The valve has a cage, a seat and a ball. The cage has a passageway extending between two ends, with the passage including a ball chamber. The ball chamber is between a perforated member and a stop. The ball is located in the ball chamber between the perforated member and the seat, which abuts the stop. The ball is movable along a raceway. The raceway has ribs with channels therebetween. The raceway skews away from a longitudinal axis of the ball chamber from the seat toward to the perforated member. The raceway can be made of a material that is either harder or softer or the same as the hardness of the inner wall of the ball chamber. In another embodiment, the valve has a throat with a stop for receiving a seat. The ball chamber has portions that are hardened. The clearance between the ball and the hardened portions of the ball chamber is at least twice as large as the clearance between the ball and the throat.

13 Claims, 6 Drawing Sheets

Fig. 9
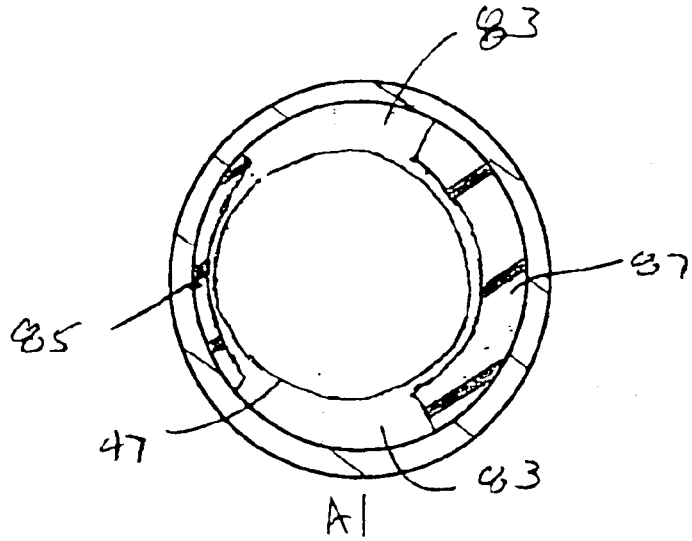
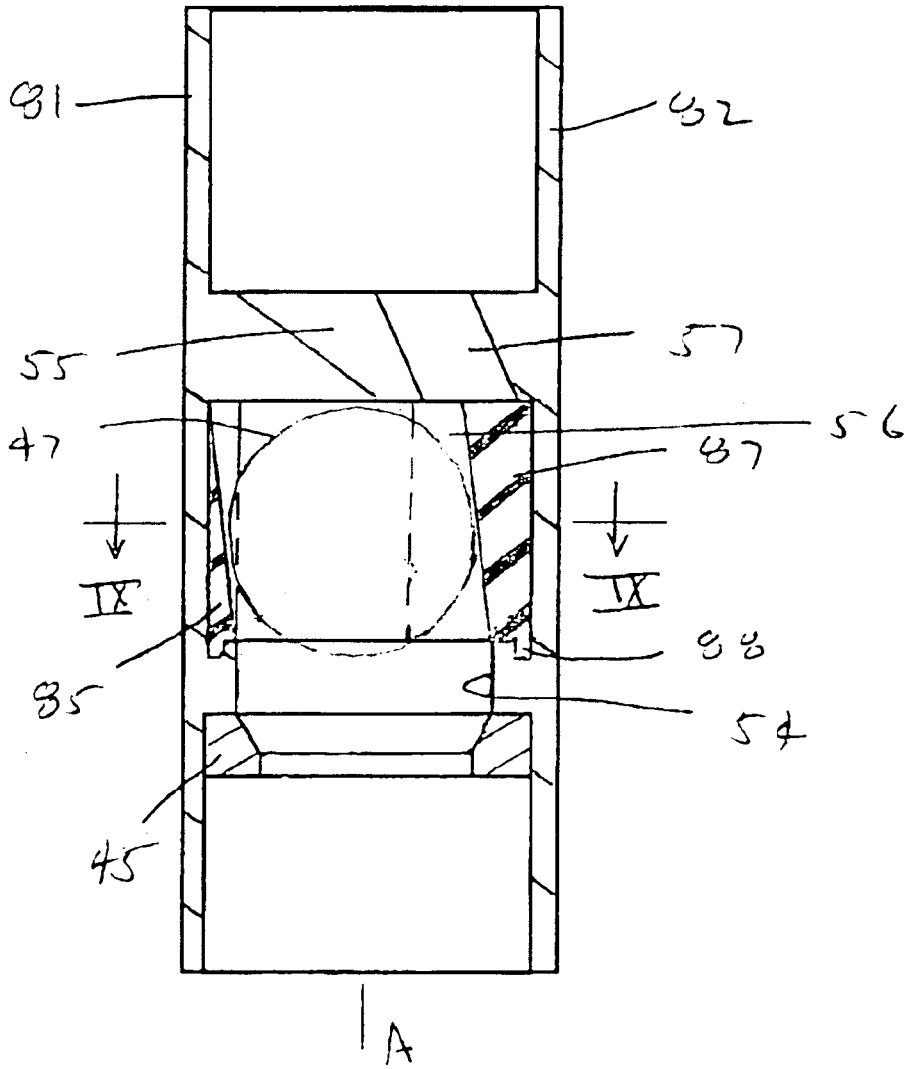
Fig. 8

VALVE FOR DOWNHOLE PUMP

This application claims the benefit of U.S. provisional application Ser. No. 60/334,885, filed Nov. 15, 2001.

FIELD OF THE INVENTION

The present invention relates to subsurface, or downhole, pumps such as are used to pump oil and other fluids and bases from oil wells, and in particular to valves used in downhole pumps.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells, and particularly those in fields that are established and aging, natural pressure has declined to the point where the oil must be artificially lifted to the surface. Subsurface, or downhole, pumps are located down in the well below the level of the oil. A string of sucker rods extends from the pump up to the surface to a pump jack device, or beam pump unit. A prime mover, such as a gasoline or diesel engine, or an electric motor, or a gas engine on the surface causes the pump jack to rock back and forth, thereby moving the stream of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a chamber between the valves with fluid and then lifts the fluid up the tubing toward the surface.

The one-way valves are designed for hostile environments. The valves are subjected to high pressures (ranging from several hundred psi to several thousand psi), high temperatures and corrosive fluids. The valves include a valve seat and a ball. The valve seat is a ring having a lapped, or shaped, surface for receiving the ball. When the ball engages the seat, the valve is closed. When the ball is disengaged from the seat, the valve is opened. Differential pressure moves the ball into or out of engagement with the seat.

In a typical pump, as the plunger is lifted up, the standing valve in the barrel is opened by the pressure differential across the standing valve; the traveling valve is closed by the pressure differential across the traveling valve. When the plunger is lowered, the standing valve in the barrel is closed, while the traveling valve in the plunger is opened.

Opening a valve is relatively simple; the higher pressure below the valve seat pushes the ball off of the seat, thereby allowing fluid to flow through the valve. Closing a valve involves reversing the pressure differential and guiding the ball back to the seat. An improperly guided ball will have difficulty seating, resulting in improper closure and leaking of the valve.

Valves are provided with ball cages to constrain the movement of the ball and ensure a properly working valve. The cage limits the movement of the ball along a narrow path. The tolerance between the ball and the inside of the cage is small in order to minimize side-to-side movement of the ball. In addition, the cage provides openings around the ball for fluid to flow.

In some prior art cages, the interior of the cage is provided with longitudinally extending ribs, or races. The ribs provide a close tolerance raceway for the ball to move into and away from the seat, while limiting side-to-side movement of the ball. The spaces between the ribs provide the openings for fluid flow.

Some wells produce relatively large quantities of sand. As the sand flows through the valve, it tends to accumulate in the openings around the ball and between the ribs. The sand accumulation chokes off fluid flow and prevents the ball from moving to open and close the valve. A pump with a sand-clogging problem loses efficiency in pumping fluid to the surface.

SUMMARY OF THE INVENTION

It is an object of the present invention to provide a valve ball cage for a downhole pump that minimizes sand accumulation in the valve.

The present invention provides a cage for use in a valve of a downhole pump. The cage has a tubular wall having a passage extending between two ends. The passage comprises a ball chamber. The ball chamber is bounded by the wall, a perforated member and a throat that opposes the perforated member. The throat comprises a stop for receiving a seat. A raceway in the ball chamber extends from the throat toward the perforated member and is structured and arranged to receive a ball. The raceway has passages therein. The raceway skews away from a longitudinal axis of the ball chamber from the throat toward the perforated member.

In accordance with one aspect of the present invention, the raceway comprises ribs. In accordance with another aspect of the present invention, the ribs are made of a material that is different than the tubular wall.

In accordance with still another aspect of the present invention, the ribs are made of a material that is harder than the tubular wall. Alternatively, the ribs are made of an elastomeric material.

In accordance with another aspect of the present invention, the ribs are made of a material that is substantially the same as the tubular wall.

The present invention also provides a cage for use in a valve of a downhole pump, which cage comprises a tubular wall having a passage extending between two ends. The passage comprises a ball chamber, with the ball chamber being bounded by the wall, a perforated member and a throat that opposes the perforated member. The throat comprises a stop for receiving a seat. The throat has a first inside diameter. At least portions of the tubular wall on the ball chamber are hardened. The tubular wall of the ball chamber has a second inside diameter between the hardened portions that is larger than the first inside diameter.

The present invention also provides a valve for use in a downhole pump. The valve comprises a cage having a passage extending between two ends, the passage comprising a ball chamber, the ball chamber being between a perforated member and a stop. The ball chamber has a wall extending from the stop to the perforated member. A seat is located in the passage and abuts the stop. A ball is located in the ball chamber between the perforated member and the seat. The ball is movable between a closed position, wherein the ball engages the seat, and an open position, wherein the ball is disengaged from the seat. A raceway is located in the ball chamber and receives the ball. The raceway comprises ribs with channels therebetween. The raceway skews away from a longitudinal axis of the ball chamber from the seat toward the perforated member so that when the ball is in the open position, the ball is offset from the longitudinal axis.

In accordance with one aspect of the present invention, the raceway comprises ribs. In accordance with another aspect of the present invention, the ribs are made of a material that is different than the tubular wall.

In accordance with still another aspect of the present invention, the ribs are made of a material that is harder than the tubular wall. Alternatively, the ribs are made of an elastomeric material.

In accordance with another aspect of the present invention, the ribs are made of a material that is substantially the same as the tubular wall.

The present invention also provides a valve for use in a downhole pump, comprising a cage having a tubular wall with a passage extending between two ends. The passage comprises a ball chamber, with the ball chamber being bounded by the wall, a perforated member and a throat that opposes the perforated member. The throat comprises a stop for receiving a seat in the passage. The throat has a first inside diameter. At least portions of the wall in the ball chamber are hardened. A ball is located in the ball chamber between the perforated member and the seat, with the ball being movable between a closed position, wherein the ball engages the seat, and an opened position, wherein the ball is disengaged from the seat. The valve has a first clearance between the ball and the throat when the ball is located in the throat and has a second clearance between the ball and the hardened portions when the ball is located in the ball chamber. The second clearance is at least twice as large as the first clearance.

The present invention also provides a downhole pump comprising a barrel and a plunger that reciprocates inside the pump. The pump has at least one valve in either the barrel or the plunger. The valve comprises a cage having a passage extending between two ends, the passage comprising a ball chamber, the ball chamber being between a perforated member and a stop. The ball chamber has a wall extending from the stop to the perforated member. A seat is located in the passage and abuts the stop. A ball is located in the ball chamber between the perforated member and the seat. The ball is movable between a closed position, wherein the ball engages the seat, and an opened position, wherein the ball is disengaged from the seat. A raceway is located in the ball chamber and receives the ball. The raceway comprises ribs with channels therebetween. The raceway skews away from a longitudinal axis of the ball chamber from the seat toward the perforated member so that when the ball is in the open position, the ball is offset from the longitudinal axis.

The present invention also provides a downhole pump comprising a barrel and a plunger that reciprocates inside the pump. The pump has at least one valve in either the barrel or the plunger. The valve comprises a cage having a passage extending between two ends, the passage comprising a ball chamber, the ball chamber being between a perforated member and a stop. The ball chamber has a wall extending from the stop to the perforated member. A seat is located in the passage and abuts the stop. A ball is located in the ball chamber between the perforated member and the seat. At least portions of the tubular wall on the ball chamber are hardened. The valve has a first clearance between the ball and the throat when the ball is located in the throat and has a second clearance between the ball and the hardened portions when the ball is located in the ball chamber. The second clearance is at least twice as large as the first clearance.

BRIEF DESCRIPTION OF THE DRAWINGS

FIG. 8 is a longitudinal cross-sectional view of the valve of the present invention, in accordance with another embodiment.

FIG. 9 is a cross-sectional view taken through lines IX—IX of FIG. 8.

DESCRIPTION OF THE PREFERRED EMBODIMENTS

Figure 1:
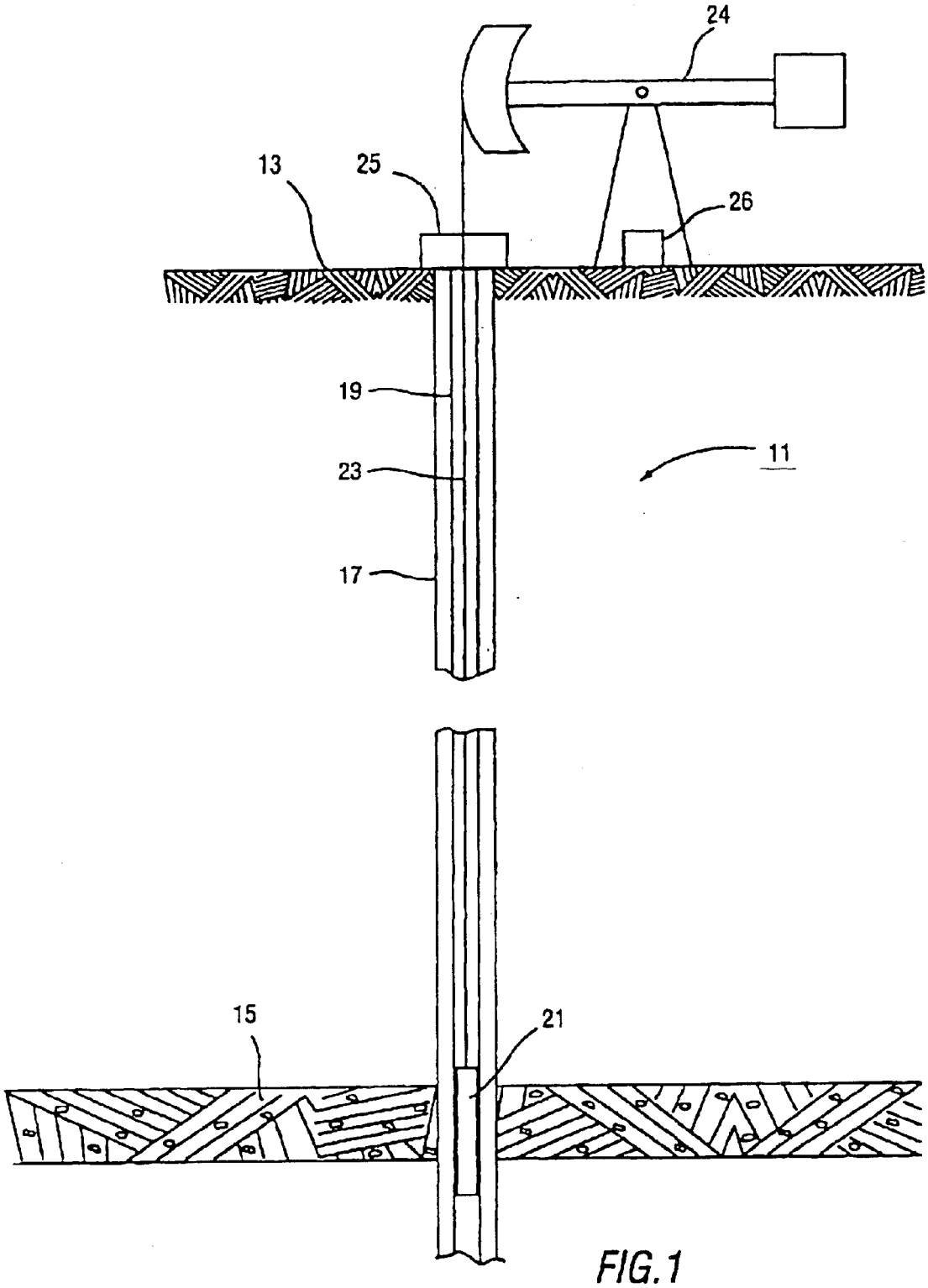
FIG. 1 is a schematic diagram of a well, shown with pumping equipment.

In FIG. 1, there is shown a schematic diagram of a producing oil well 11. The well has a borehole that extends from the surface 13 into the earth, past an oil-bearing formation 15. The borehole has been completed and therefore has casing 17 which is perforated at the formation 15. A packer or other method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod at a stuffing box 25 on the surface 13. The sucker rod string 23 is connected to a pump jack unit 24 which reciprocates up and down due to a prime mover 26, such as an electric motor, gasoline or diesel engine, or gas engine.

Figure 2:
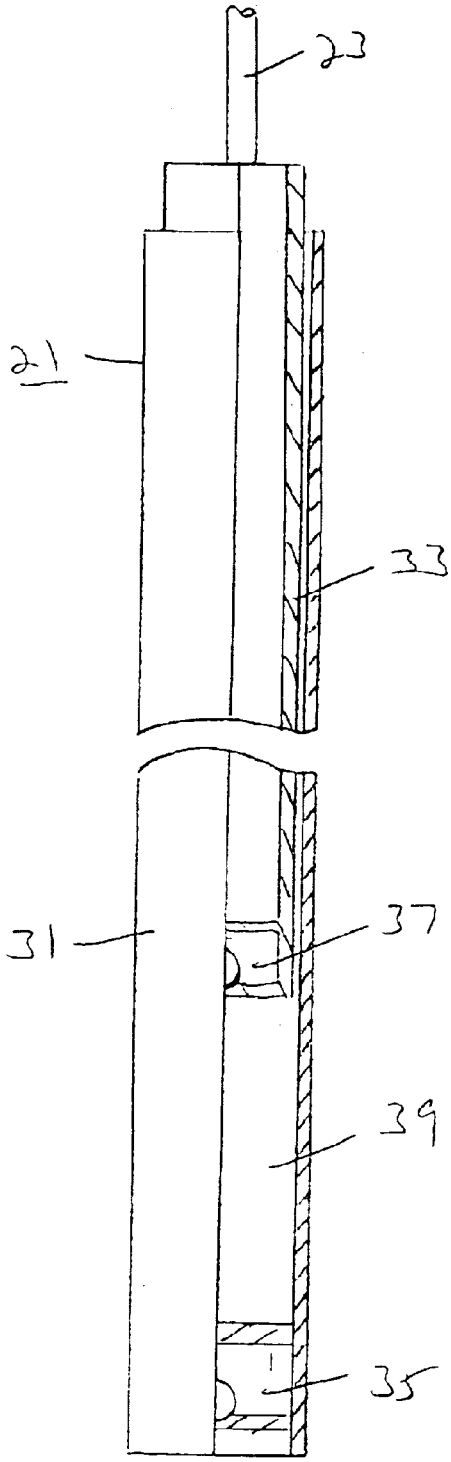
FIG. 2 is a longitudinal partial cross-sectional view of a downhole pump.

FIG. 2 schematically illustrates the downhole pump 21. The pump 21 has a barrel 31 and a plunger 33 that reciprocates inside of the barrel. The barrel 31 has a standing valve 35 and the plunger has a traveling valve 37. The pump 21 may have additional valves. The pump is shown for illustration purposes. The present invention may be used in a variety of pumps, such as insert type pumps and tubing type pumps. The invention can also be used on stationary barrel type pumps, regardless of whether the barrel is top anchored or bottom anchored. The invention can be used on traveling barrel type pumps as well.

The plunger 33 is reciprocated inside of the barrel by the sucker rods 23. As the plunger is raised on the upstroke, fluid is drawn through the standing valve 35 into a barrel chamber 39; the traveling valve 37 is closed. As the plunger 33 descends on the downstroke, the standing valve 35 is closed and the fluid in the barrel chamber is pushed through the traveling valve 37 into the plunger and the tubing above the plunger. This fluid is lifted on the next upstroke. The reciprocating movement of the plunger inside of the barrel is repeated to lift the fluid to the surface.

Ideally, the fluid contains only liquid, such as oil. However, there may be sand in the fluid. The sand, being coated with sticky oil, has a tendency to accumulate in small passages such as inside of the valves 35, 37.

Figure 5:
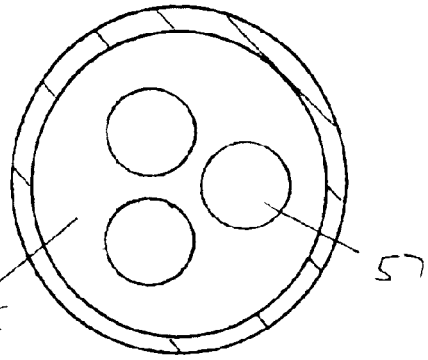
Fig. 5 Prior Art
FIG. 5 is a cross-sectional view, taken through lines V—V of FIG. 3.
Figure 4:
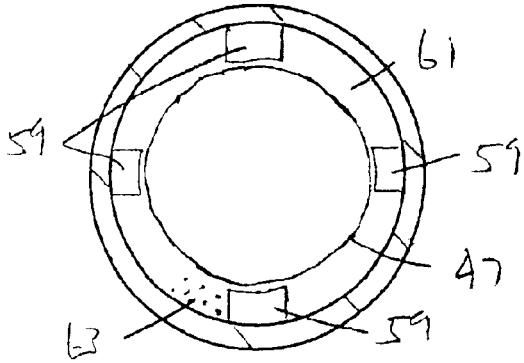
Fig. 4 Prior Art
FIG. 4 is a cross-sectional view, taken through lines IV—IV of FIG. 3.
Figure 3:
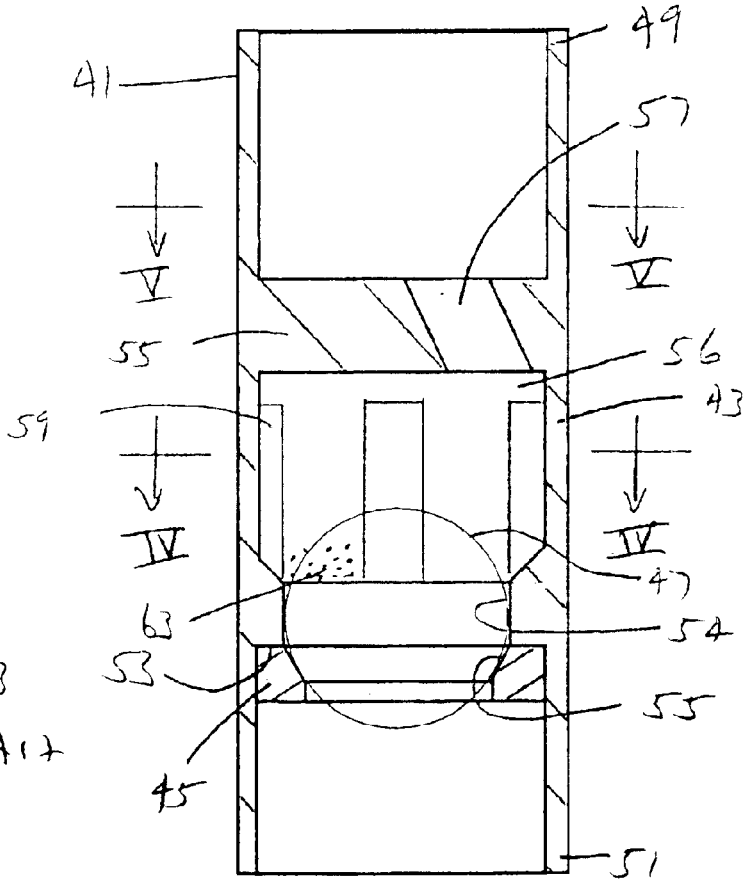
Fig. 3 Prior Art
FIG. 3 is a longitudinal cross-sectional view of a prior art valve, showing a cage, a valve seat and a ball.

FIGS. 3–5 show a prior art valve 41. The valve 41 has a cage 43, a seat 45 and a ball 47. In FIGS. 3, 6, 8 and 10, the ball 47 is shown in outline for illustrative purposes.

The cage 43 is generally tubular, having two ends 49, 51. For ease of description, the ends will be referred to as "upper" and "lower", corresponding to the orientation shown in the figures. The seat 45 is inserted into the lower end 51, bearing against a stop shoulder 53. The stop shoulder 53 forms a throat 54. The seat 45 has a lapped surface 55 that receives a portion of the ball 47, wherein when the ball seats in the seat, the valve is closed. Because the seat can wear faster than the cage, it is designed to be replaced relative to the cage. Likewise, the ball is also designed to be replaced relative to the cage. An annular seat retainer (not shown) is threaded into the lower end 51 of the cage so as to hold the seat 45 against the stop surface 53. Near the upper end 49 of the cage, a transverse wall 55 is provided, which wall has openings 57 therethrough. The ball 47 is contained between the wall 55 and the seat 45 inside of a ball chamber 56. The ball chamber 56 has a larger inside diameter than the inside diameter of the throat 54. The ball 47 is sized to pass through the throat 54.

The ball is made of a material that is harder than the cage. Therefore, the walls of the ball chamber 56 has races or ribs 59 made of stellite, a hard metal. The stellite ribs 59 are harder than the side walls of the ball chamber 56 and therefore protect the side walls from the ball.

The ball 47 moves between opened and closed positions. In the closed position, the ball 47 is in contact with the lapped surface 55 of the seat 45. In the opened position, the ball is away from the seat. Fluid flows through the seat, around the ball and out through the openings 57. When the fluid flows around the ball 47, it flows between the ribs 59. Thus, a passage 61 are formed between the ribs 59. Also, a small clearance is provided between the ball 47 and the ribs 59 so as to allow the ball to move longitudinally relative to the ribs.

Sand 63 can accumulate in the passages 61 between the ribs, thereby reducing fluid flow through the valve. The sand accumulation may be severe enough to prevent the ball from sealing against the seat 45.

Figure 7:
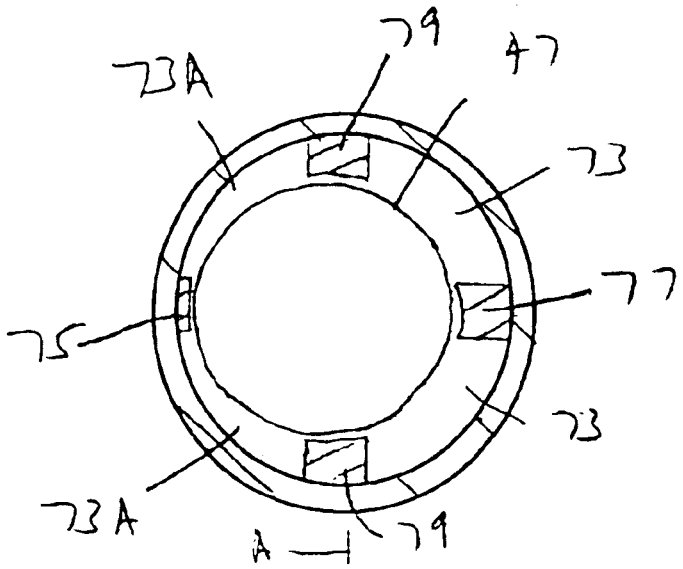
FIG. 7 is a cross-sectional view taken through lines VII—VII of FIG. 6.
Figure 6:
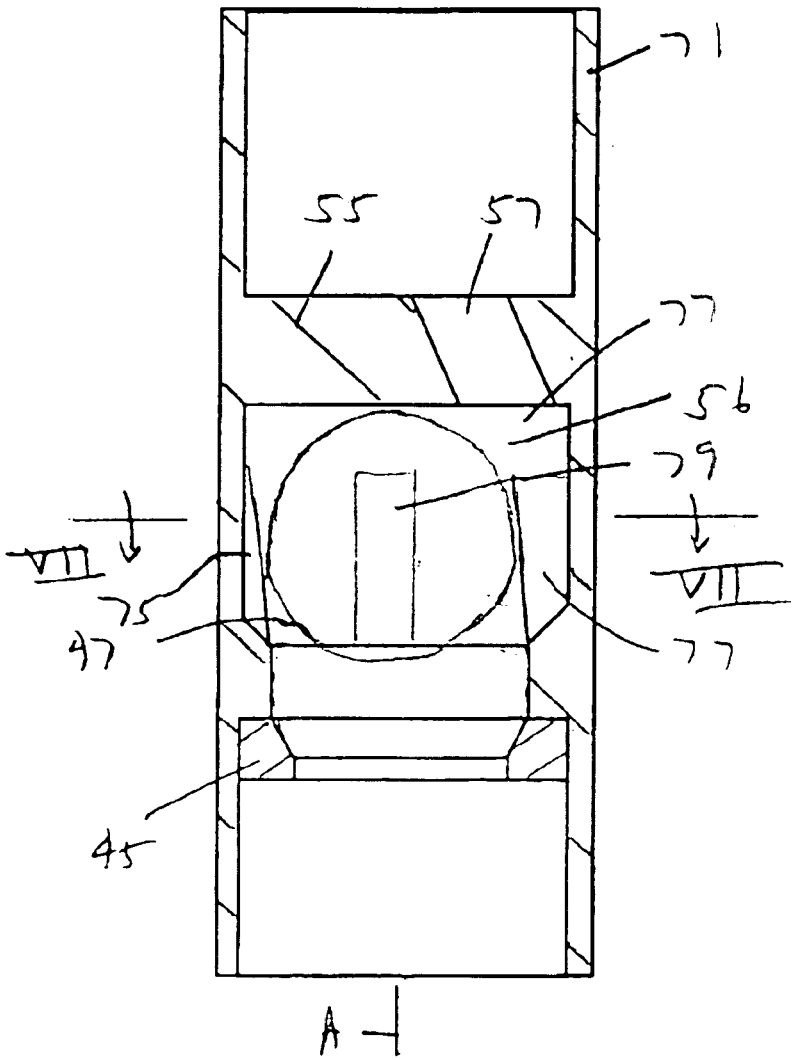
FIG. 6 is a longitudinal cross-sectional view of the valve of the present invention, in accordance with a preferred embodiment.

The present invention in accordance with a first embodiment provides a cage 71 with larger passages around the ball, thereby reducing the opportunity for sand to accumulate in the passages. As shown in FIGS. 6 and 7, the passages are formed by skewing the path the ball travels away from the seat; the path is skewed off of the longitudinal axis in the cage. Thus, when the valve is opened (the ball is away from the seat), the ball is off to one side of the cage, leaving large passages 73 around the ball on the other side of the cage.

The skewed pathway, or raceway, is formed with the ribs. As shown in FIG. 6, one rib 75 tapers from the seat 45 toward the wall 55 with decreasing thickness. The opposite rib 77 tapers with increasing thickness from the seat 45 toward the wall 55. The other ribs 79 need not be tapered. As the ball 47 travels between these two ribs 75, 77 from the seat 45 toward the wall 55, the ball is shifted toward the left (in the view shown in FIGS. 6 and 7) and the ball is no longer centered along the longitudinal axis A—A of the cage 71. The ribs 75, 77, 79 limit the side-to-side (transverse) movement of the ball. The ribs 75, 77, 79 are made of a harder material than the cage. For example, the ribs can be made of stellite. Alternatively, the ribs 75, 77, 79 have a hardness that is substantially the same as the cage. In addition to stellite, the ribs can be steel, stainless steel or monel.

While the total cross-sectional area of the passages 73, 73A is the same in the valve of FIGS. 6 and 7 as in the valve of FIG. 3, two of the passages 73 in the valve of FIGS. 6 and 7 are larger. The sand is less likely to clog these passages 73.

FIGS. 8 and 9 illustrate the valve 81 in accordance with a second embodiment. The cage 82 of the valve 81 is similar to the cage 71 of FIG. 6. The cage 82 is equipped with a skewed raceway so as to form large passages 83 around the ball 47 when the valve is open. The raceway is made of elastomeric ribs 85, 87. Thus, while the ribs 75, 77, 79 of FIGS. 6 and 7 are made of a harder material than the cage 71, the ribs 85, 87 are softer. In addition, the ribs 85, 87 are wider in cross-section, as shown in FIG. 9, than are the ribs of FIGS. 6 and 7. The individual ribs 85, 87, 89 are fitted into a groove 88 near the throat 54. This helps secure the ribs inside the ball chamber. The ribs 85, 87 are also glued to the cage 82.

Rubber lined cages are known in the prior art. The rubber lining is located inside of the ball chamber 56 and provides ribs with passages between the ribs. The rubber ribs are secured inside of the ball chamber by the groove 88 and by extending to the wall 55. However, the prior art rubber ribs provide a raceway that is aligned with a longitudinal axis A—A of the cage. With the cage of FIGS. 8 and 9, the raceway is skewed or angled from the longitudinal axis so that the large passages 83 are created around the ball 47 when the valve is open.

Figure 11:
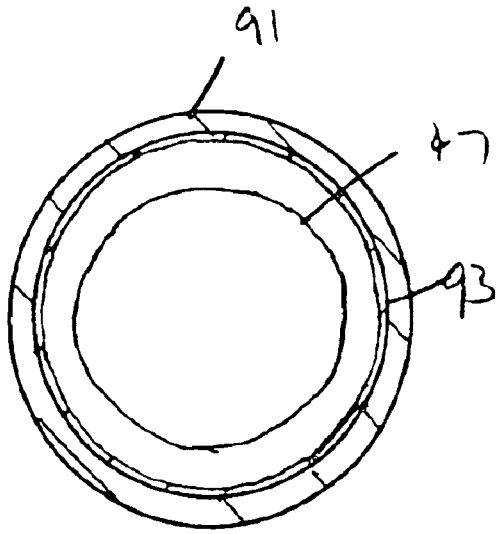
FIG. 11 is a cross-sectional view, taken through lines XI—XI of FIG. 10.
Figure 10:
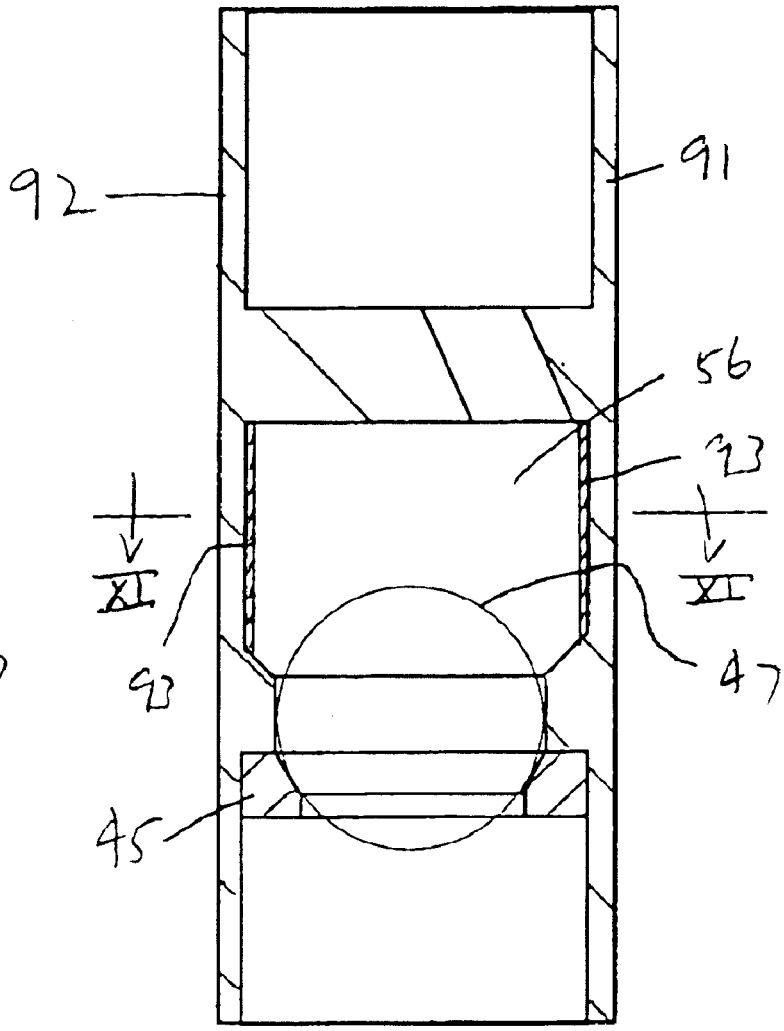
FIG. 10 is a longitudinal cross-sectional view of the valve of the present invention, in accordance with another embodiment.

FIGS. 10 and 11 illustrate the valve 91, in accordance with a third another embodiment. The ball chamber 56 of the cage 92 is not provided with ribs. Consequently, the ball can exhibit more side-to-side movement in the ball chamber 56. The inner surface 93 of the ball chamber 56 is hardened. In the preferred third embodiment, the inner surface is treated with a carbonizing process or a boronizing process to a thickness of 0.005–0.010 inches. The carbonizing process hardens the inner surface. Carbonizing is a well known process. Boronizing is described in U.S. Pat. No. 6,258,172, the disclosure of which is incorporated by reference. The carbonizing process treats the ball chamber inner surface to a hardness of Rockwall C 62 or higher and the boronizing process treats the ball chamber inner surface to a hardness of Rockwall C 75 or higher. The hardness of the base steel of the cage 92 is about Rockwall C 10. The ball 47 has a hardness of about Rockwall C 58. These hardness values can vary and are given here as examples.

In the prior art cage 49 of FIG. 3, the clearance between the ball 47 and the ribs 59 is about 0.030 inches. The clearance between the ball 47 and the throat 54 is about 0.030 inches. In the cage 92 of FIG. 10, the clearance between the ball 47 and the inner surface 93 is at least twice that (0.060 inches) and preferably even greater. In the embodiment of FIG. 10, the clearance between the ball 47 and the inner surface 93 of the ball chamber 56 is ⅛–3⁄16 inches. With such a large clearance, sand is less likely to become lodged or accumulate around the ball the pump will produce efficiently.

The foregoing disclosure and showings made in the drawings are merely illustrative of the principles of this invention and are not to be interpreted in a limiting sense.

What is claimed is:

1. A cage for use in a valve of a downhole pump, comprising:

a) a tubular wall having a passage extending between two ends, the passage comprising a ball chamber, the ball chamber being bounded by the wall, a perforated member and a throat that opposes the perforated member;

b) the throat comprising a stop for receiving a seat;

c) a raceway in the ball chamber extending from the throat toward the perforated member and structured and arranged to receive a ball, the raceway having channels communicating therewith, the raceway skewing away from a longitudinal axis of the ball chamber from the throat toward the perforated member, the longitudinal axis extending between the two ends.

2. The cage of claim 1 wherein the raceway comprises ribs.

3. The cage of claim 2 wherein the ribs are made of a material that is different than the tubular wall.

4. The cage of claim 3 wherein the ribs are made of a material that is harder than the tubular wall.

5. The cage of claim 3 wherein the ribs are made of an elastomeric material.

6. The cage of claim 2 wherein the ribs are made of a material that is substantially the same as the tubular wall.

7. A valve for use in a downhole pump, comprising:

a) a cage having a passage extending between two ends, the passage comprising a ball chamber, the ball chamber being between a perforated member and a stop, the ball chamber having a wall extending from the stop to the perforated member;

b) a seat located in the passage and abutting the stop;

c) a ball located in the ball chamber between the perforated member and the seat, the ball being movable between a closed position, wherein the ball engages the seat, and an open position, wherein the ball is disengaged from the seat;

d) a raceway located in the ball chamber and receiving the ball, the raceway comprising ribs with channels therebetween, the raceway skewing away from a longitudinal axis of the ball chamber from the seat toward the perforated member so that when the ball is in the open position, the ball is offset from the longitudinal axis.

8. The valve of claim 7 wherein the raceway comprises ribs.

9. The valve of claim 8 wherein the ribs are made of a material that is different than the tubular wall.

10. The valve of claimed 9 wherein the ribs are made of a material that is harder than the tubular wall.

11. The valve of claim 9 wherein the ribs are made of an elastomeric material.

12. The valve of claim 8 wherein the ribs are made of a material that is substantially the same as the tubular wall.

13. A downhole pump, comprising:

a) a barrel;

b) a plunger capable of reciprocating inside of said barrel;

c) at least one valve in one of the plunger or the barrel, the valve comprising:

i) a cage having a passage extending between two ends, the passage comprising a ball chamber, the ball chamber being between a perforated member and a stop, the ball chamber having a wall extending from the stop to the perforated member;

ii) a seat located in the passage and abutting the stop;

iii) a ball located in the ball chamber between the perforated member and the seat, the ball being movable between a closed position, wherein the ball engages the seat, and an open position, wherein the ball is disengaged from the seat;

iv) a raceway located in the ball chamber and receiving the ball, the raceway comprising ribs with channels therebetween, the raceway skewing away from a longitudinal axis of the ball chamber from the seat toward the perforated member so that when the ball is in the open position, the ball is offset from the longitudinal axis.

* * * * *